US006928677B1

(12) United States Patent
Pittman

(10) Patent No.: US 6,928,677 B1
(45) Date of Patent: Aug. 16, 2005

(54) THERAPEUTIC PILLOW

(76) Inventor: Ben R. Pittman, 93 Egret Run La. Unit III, Pawleys Island, SC (US) 29585

( * ) Notice: Subject to any disclaimer, the term of this patent is extended or adjusted under 35 U.S.C. 154(b) by 0 days.

(21) Appl. No.: 10/374,336

(22) Filed: Feb. 27, 2003

(51) Int. Cl.[7] ..... A47G 9/00
(52) U.S. Cl. ..... 5/636; 5/645
(58) Field of Search ..... 5/636, 639, 640, 5/645

(56) References Cited

U.S. PATENT DOCUMENTS 2,761,493 A * 9/1956 Lenz ..... 267/145
3,109,182 A * 11/1963 Doak ..... 5/636
3,148,389 A * 9/1964 Lustig ..... 5/645
3,283,346 A * 11/1966 Marsh et al. ..... 428/101
3,327,333 A * 6/1967 Jessup ..... 297/461
3,335,435 A * 8/1967 Marsh et al. ..... 5/652
3,403,414 A * 10/1968 Unger ..... 5/636
3,840,918 A * 10/1974 Shave ..... 5/640
3,863,283 A * 2/1975 Mohr ..... 5/639
4,080,675 A * 3/1978 Kanowsky et al. .... 297/452.58
4,207,636 A * 6/1980 Ceriani ..... 428/101
D257,105 S * 9/1980 Morris ..... D6/601
4,508,044 A * 4/1985 Downey et al. ..... 112/475.08
4,606,088 A * 8/1986 Michaelsen et al. ..... 5/636
4,799,275 A * 1/1989 Sprague, Jr. ..... 5/652
4,930,173 A * 6/1990 Woller ..... 297/452.48
5,256,236 A * 10/1993 Woller ..... 156/290
5,265,295 A * 11/1993 Sturgis ..... 5/655.9
5,394,578 A * 3/1995 Sturgis ..... 29/91
5,636,397 A * 6/1997 Boyd et al. ..... 5/739

FOREIGN PATENT DOCUMENTS

GB 132171 6 A * 6/1973 ..... 5/636

* cited by examiner

*Primary Examiner*—Robert G. Santos
(74) *Attorney, Agent, or Firm*—B. Craig Killough

(57) ABSTRACT

A pillow includes a pillow base having a top, bottom, front, rear and opposite sides. The base includes first and second compartments defining areas which extend between the opposite sides. A quantity of fill material is disposed within the first compartment. A support member is enclosed within the second chamber. The support member includes a resilient body having a top wall, a bottom wall, a front wall, a rear wall, and spaced apart side walls. The front wall includes a slot extending between the side walls. The support member is disposed adjacent to at least the front of the pillow base.

14 Claims, 2 Drawing Sheets

THERAPEUTIC PILLOW

TECHNICAL FIELD OF THE INVENTION

The present invention relates to a therapeutic pillow, and more particularly to a pillow having a head and neck cushion enclosed within a pillow chamber.

BACKGROUND OF THE INVENTION

In order for a pillow to function as a superior sleep aid, to allow a user to complete a higher percentage of sleep cycles including the highest percentage of REM sleep as possible, a pillow must: allow for and maintain the correct spinal alignment; provide a soft support for the entire neck and head area; and minimize the motion of fill material due to the weight of the head and neck. The above requirements are difficult to accomplish simultaneously in a pillow. While some of these objectives can be met in pillows which are traditionally soft or hard, such pillows are deficient in accomplishing all these desired objectives.

When using a soft pillow over a short period of time, correct spinal alignment is not maintained, resulting in spinal suppression/extension problems and associated muscular problems as the muscles attempt to maintain the head in its normal position or muscles remain stretched in a non-ordinary manner. Soft pillows frequently require the fill to be fluffed often which prevents continuous neck and head support. Such soft pillows also do not provide for minimization of fill movement due to the weight of the head and neck. Soft pillows also compress/compact rapidly over multiple periods of use, and lose their original size/thickness definition rapidly.

Hard pillows on the other hand, present a different set of problems. Although hard pillows provide a more stable platform for spinal alignment, the correct thickness of the pillow becomes an important consideration. The user's neck and head area will only be comfortable if the pillow is fitted or specifically designed for the particular neck/head configuration of the user. The neck muscles are sensitive to inordinate stretches and compressions created by an improperly sized pillow, which results in variations in the desired spinal alignment. Therefore, hard pillows quickly fail to achieve the necessary spinal alignment unless such a pillow is molded or shaped to fit the exact head/neck configuration of the user. The desired soft support for the neck and head area of the user is generally not achieved by such hard pillows. Further, the desired requirement of minimal fill movement is generally not achieved if a hard pillow does not match the user's particular body configuration.

A need has also arisen for a pillow that allows for and maintains correct spinal alignment while providing for soft support for the entire neck and head area of the user while simultaneously minimizing fill movement due to the weight of the head and neck of the user.

SUMMARY OF THE INVENTION

The present therapeutic pillow is designed to allow a user to complete a higher percentage of sleep cycles including a higher percentage of REM sleep as possible by addressing the above-defined requirements for a pillow. The present pillow base includes two distinct compartments which alters the natural flow of fill material in such a manner as to allow each compartment to resist fill movement due to the weight of the head and neck of the user. The present pillow utilizes inserts which inhibits the alteration of the thickness of the pillow during use. Loss of thickness is referred to as "losing tolerance" because the pillow has an initial thickness and after use looses thickness to a point where there is discomfort in muscles and skeleton areas of the neck. As thickness is lost, correct spinal alignment is lost. Therefore, the present invention functions to "hold tolerance" due to the use of the present two chamber system which inhibits the flow of fill material and the use of the present inserts.

The present therapeutic pillow having a soft outer portion provides for the desired soft support of the entire neck and head area of the user. The inside portion of the pillow remains firm due to the use of the present inserts which continue to hold tolerance necessary to keep the correct spinal alignment.

The present pillow and insert design allows a pillow to be utilized in any direction independent of bottom, top or sides.

In accordance with the present invention, a pillow base includes a top, bottom, front, rear and opposite sides. The base includes first and second compartments defining areas which extend between the opposite sides. A quantity of fill material is disposed within the first compartment. A support member is enclosed within the second chamber. The support member includes a resilient body having a top wall, a bottom wall, a front wall, a rear wall, and spaced apart side walls. The front wall includes a slot extending between the side walls. The support member is disposed adjacent to at least the front of the pillow base.

DESCRIPTION OF THE PREFERRED EMBODIMENTS

Figure 1:
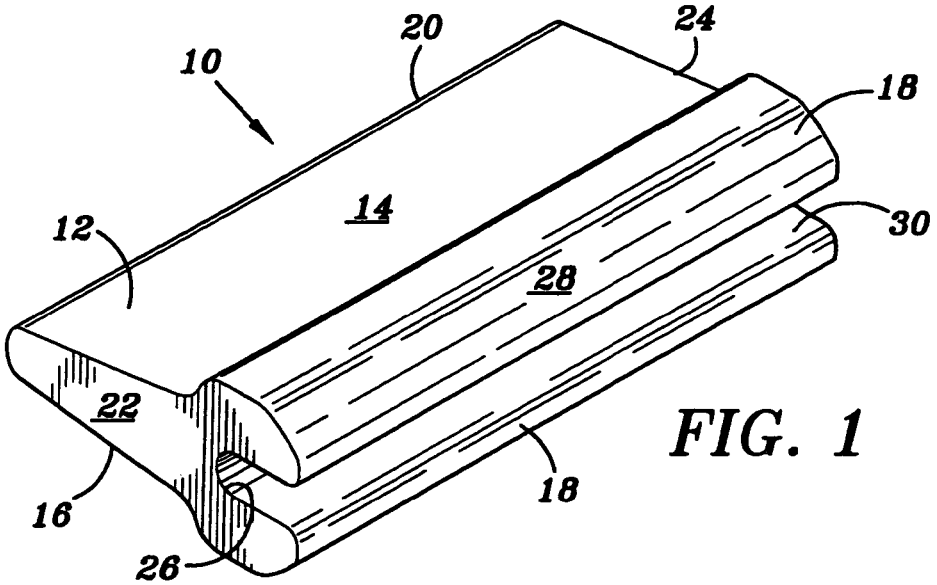
FIG. 1 is a front perspective view of the present pillow insert.
Figure 2:
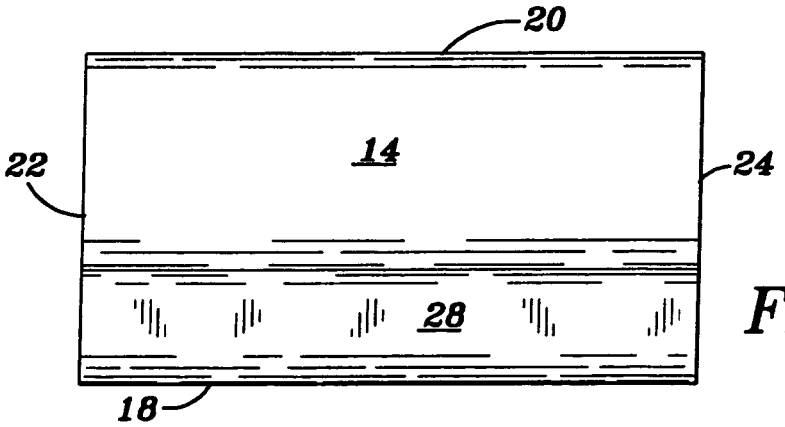
FIG. 2 is a top plan view of the present insert, the bottom plan view being identical thereto.
Figure 3:
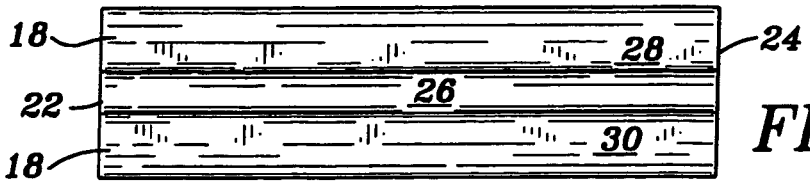
FIG. 3 is a front elevational view of the present insert.
Figure 4:
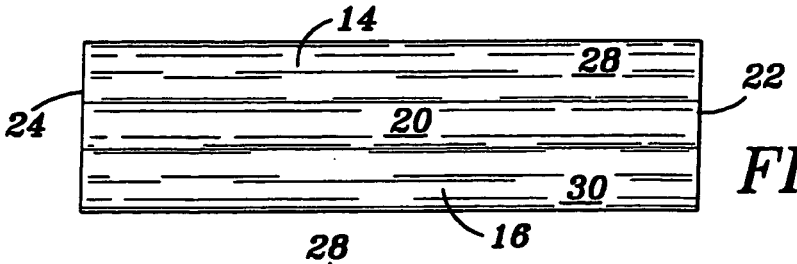
FIG. 4 is a rear elevational view of the present insert.
Figure 5:
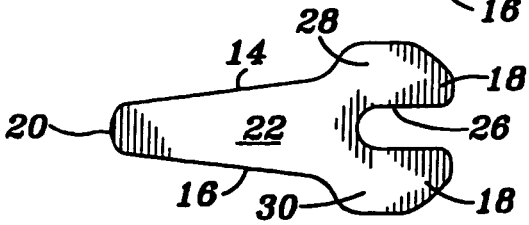
FIG. 5 is a left side elevational view of the present insert, the right side being identical thereto.

Referring simultaneously to FIGS. 1–5, the present pillow insert is illustrated, and is generally identified by the numeral 10. Insert 10 is fabricated from high resiliency foam such as, for example, type AM23025C, and includes additives to resist the growth of bacterial odors, and protects against the deterioration by fungus, mold and mildew. The present insert provides the desired "hardness" requirements for a pillow to provide a user with the desired spinal alignment.

Insert 10 includes a resilient body 12 having a top wall 14, a bottom wall 16, a front wall 18, a rear wall 20, and spaced apart side walls 22 and 24.

Front wall 18 includes a slot 26 which partially divides body 12 adjacent to front wall 18 into a top segment 28 and a bottom segment 30. Slot 26 allows for the relative movement between segments 28 and 30 to accommodate the compression forces exerted by the head and neck area of a user in order to provide stable spinal alignment. Slot 26 allows for adjustability and accommodation for varying head and neck weights while simultaneously providing a stable support without the need for a precisely molded or shaped insert designed for a specific user.

Figure 6:
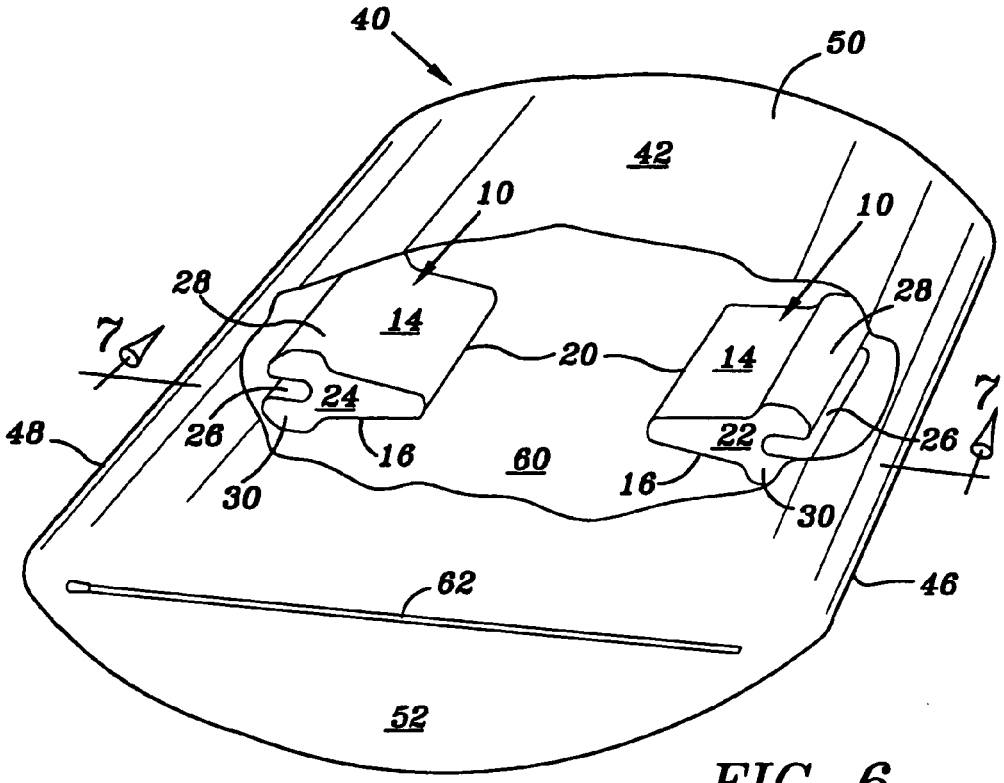
FIG. 6 is a perspective view, partially broken away, of the present pillow illustrating a pair of inserts disposed therein.
Figure 7:
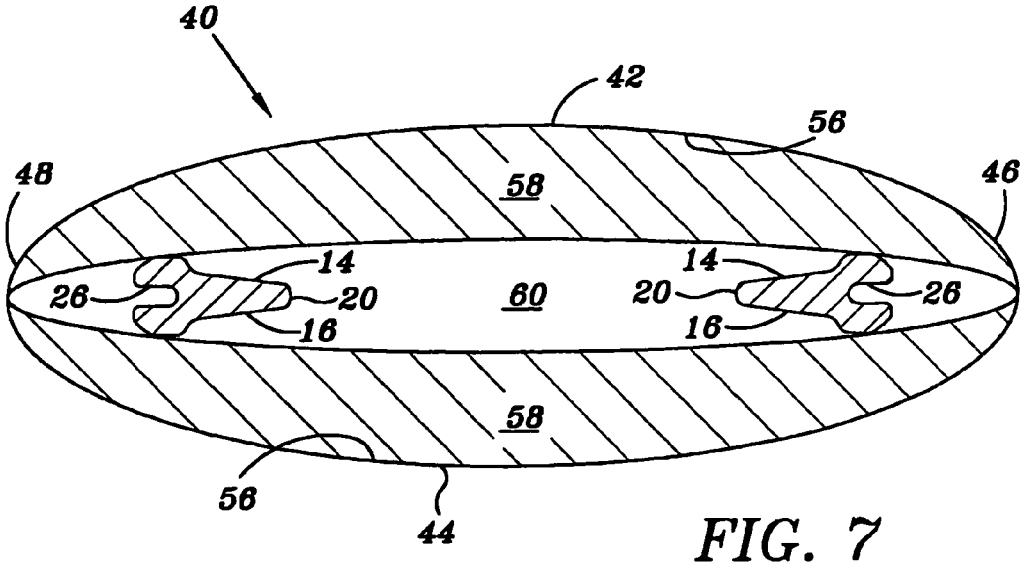
FIG. 7 is a sectional view of the present pillow taken generally along sectional lines 7—7 of FIG. 6.

Referring simultaneously to FIGS. 6 and 7, the present therapeutic pillow is illustrated, and is generally identified by the numeral 40. Pillow 40 includes a top surface 42, a bottom surface 44, a front 46, rear 48, and spaced apart sides 50 and 52. Pillow 40 includes a fill chamber 56 filled with a quantity of fibrous material 58 such as, for example, DuPont Comforel fill. Pillow 40 includes a second chamber 60 which is void of fill material, and which receives a pair of inserts 10. Pillow 40 includes a zipper 62 or other fastening device, in order to gain access to chamber 60 for insertion and removal of inserts 10. Inserts 10 are aligned such that slots 26 are aligned with front 46 and rear 48 of pillow 40. Fibrous material 58 provides the required soft support for the neck and head area of the user. Compartment 60 functions to minimize movement of fill material 58 and functions to locate and maintain inserts 10 in their desired position adjacent to front 46 and rear 48 of pillow 40.

It therefore can be seen that the present invention provides for a therapeutic pillow that simultaneously achieves the objectives of maintaining correct spinal alignment, providing soft head and neck support while minimizing fill movement. The present inserts provide underlying support that is generally found in hard pillows with the advantage of having a pillow with a soft fill chamber to provide for soft support of the neck and head area of a user. The multiple compartment configuration of the present pillow minimizes fill movement. The present pillow may be utilized in multiple directions during use and receive the same feel by utilizing two inserts such that the pillow can be used independent of top or bottom or front or rear.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A pillow for receiving the head and neck of a user in a resting position comprising:

a pillow base having a first compartment and a second compartment defined therein;

a quantity of fibrous material disposed in said first compartment, said second compartment being void of material;

a support member disposed within said second compartment, said support member comprising a front portion and a rear portion, wherein said front portion is enlarged relative to said rear portion, and wherein said front portion of said support member is positioned adjacent to a front of said pillow; and a second support member disposed within said second compartment, said second support member comprising a front portion and a rear portion, wherein said front portion is enlarged relative to said rear portion, and wherein said front portion of said second support member is positioned adjacent to a rear of said pillow.

2. A pillow for receiving the head and neck of a user in a resting position as described in claim 1, wherein said front portion of said support member has a slot formed therein.

3. A pillow for receiving the head and neck of a user in a resting position as described in claim 2, wherein said slot of said support member is generally U-shaped, and said slot of said support member comprises generally opposing and parallel sides.

4. A pillow for receiving the head and neck of a user in a resting position as described in claim 1, wherein said front portion of said second support member has a slot formed therein.

5. A pillow for receiving the head and neck of a user in a resting position as described in claim 1, wherein said support member and said second support member are positioned opposite and substantially equidistant from a center line of said pillow.

6. A pillow for receiving the head and neck of a user in a resting position as described in claim 1, wherein each of said support member and said second support member are substantially symmetrical about a horizontal plane through a center thereof.

7. A pillow for receiving the head and neck of a user in a resting position as described in claim 1, wherein, in use, substantially all of said first compartment is positioned above said second compartment.

8. A pillow for receiving the head and neck of a user in a resting position as described in claim 1, wherein, in use, substantially all of said first compartment is positioned below said second compartment.

9. A pillow for receiving the head and neck of a user in a resting position comprising:

a pillow base having a first compartment and a second compartment defined therein;

a quantity of fibrous material disposed in said first compartment, said second compartment being void of material;

a support member disposed within said second compartment, said support member comprising a front portion and a rear portion, wherein said front portion is enlarged relative to said rear portion, and wherein said front portion of said support member is positioned adjacent to a front of said pillow, wherein said front portion of said support member has a slot formed therein, and wherein said slot of said support member is generally U-shaped, and said slot comprises generally opposing and parallel sides.

10. A pillow for receiving the head and neck of a user in a resting position as described in claim 9, wherein said slot of said support member opens toward a front of said pillow.

11. A pillow for receiving the head and neck of a user in a resting position as described in claim 9, further comprising a second support member disposed within said second compartment.

12. A pillow for receiving the head and neck of a user in a resting position comprising:

a pillow base having a first compartment, a second compartment and a third compartment defined therein;

a quantity of fibrous material disposed in said first compartment and said third compartment, said second compartment being void of fibrous material;

a support member disposed within said second compartment, said support member comprising a front portion and a rear portion, wherein said front portion is enlarged relative to said rear portion, and wherein said front portion of said support member is positioned adjacent to a front of said pillow.

13. A pillow for receiving the head and neck of a user in a resting position as described in claim 12, wherein, in use, substantially all of said third compartment is positioned below said second compartment.

14. A pillow for receiving the head and neck of a user in a resting position as described in claim 12, further comprising a second support member disposed within said second compartment.

* * * * *